US006517131B1

(12) United States Patent
Haataja

(10) Patent No.: US 6,517,131 B1
(45) Date of Patent: Feb. 11, 2003

(54) SUSPENDED LOAD ROTARY DEVICE

(76) Inventor: Thomas Haataja, 238 E. Washington, Howell, MI (US) 48843

( * ) Notice: Subject to any disclaimer, the term of this patent is extended or adjusted under 35 U.S.C. 154(b) by 11 days.

(21) Appl. No.: 09/932,586

(22) Filed: Aug. 17, 2001

Related U.S. Application Data

(60) Provisional application No. 60/226,201, filed on Aug. 18, 2000.

(51) Int. Cl.[7] ..... B66C 1/34

(52) U.S. Cl. ..... 294/82.15; 212/242; 212/251

(58) Field of Search ..... 294/82.12, 82.15, 294/86.41, 67.5; 212/242, 251, 318; 414/626; 74/420

(56) References Cited

U.S. PATENT DOCUMENTS

| | | | | | |
|---|---|---|---|---|---|
| 1,577,283 | A | * | 3/1926 | Mitchell | 294/82.15 |
| 1,993,346 | A | * | 3/1935 | Kelso | 212/251 |
| 2,736,600 | A | * | 2/1956 | Carlson | 294/86.41 |
| 2,823,944 | A | | 2/1958 | Anderson et al. | 294/82.15 |
| 3,009,728 | A | | 11/1961 | Breslav | 294/82.15 |
| 3,037,804 | A | | 6/1962 | Kraeling et al. | 294/82.15 |
| 3,046,046 | A | | 7/1962 | Gris | 294/82.15 |
| 3,210,115 | A | | 10/1965 | Graham et al. | 294/82.15 |
| 3,633,961 | A | | 1/1972 | Speransky | 294/82.15 |
| 3,881,263 | A | * | 5/1975 | Coeurderoy | 294/86.41 |
| 5,125,707 | A | | 6/1992 | Chaen et al. | 294/82.15 |
| 5,492,236 | A | * | 2/1996 | Foy | 212/318 |
| 5,653,350 | A | * | 8/1997 | Maki | 212/317 |

FOREIGN PATENT DOCUMENTS

| | | | | |
|---|---|---|---|---|
| CA | 0737356 | * | 6/1966 | 294/86.41 |
| JP | 406156970 | * | 6/1994 | 294/82.15 |
| WO | WO 90/14300 | * | 11/1990 | 294/82.15 |

* cited by examiner

*Primary Examiner*—Christopher P. Ellis
*Assistant Examiner*—Paul T. Chin
(74) *Attorney, Agent, or Firm*—Mary M. Moyne; Ian C. McLeod

(57) ABSTRACT

A unit (10) having a boom (12) and rotary device (14). The rotary device includes a first bracket (22), a second bracket (24) movably mounted to the first bracket and a third bracket (54) connected to the second bracket by a driven shaft (34). A motor (40) is mounted on a motor bracket (38) mounted to the second bracket. A drive gear (46) is mounted on the motor and engages a driven gear (48) mounted on the driven shaft. A friction plate (56) is located on the driven shaft adjacent the third bracket. When a load (102) is connected to the third bracket, the weight of the load pulls the third bracket downward into contact with the friction plate. The frictional contact between the third bracket and the friction plate causes the third bracket and the load to rotate when the drive shaft is rotated.

32 Claims, 4 Drawing Sheets

SUSPENDED LOAD ROTARY DEVICE

CROSS-REFERENCE TO RELATED APPLICATIONS

The application claims the benefit of U.S. Provisional Application No. 60/226,201 filed Aug. 18, 2000.

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION (1) Field of the Invention

The present invention relates to a rotary device which is used for rotating a suspended load. In particular, the present invention relates to a rotary device which has a boom which connects to a material handler vehicle for rotating a load lifted by the material handler vehicle.

(2) Description of the Related Art

The ability to lift and rotate suspended loads with precision control greatly enhances any lifting operation. To rotate a suspended load safely, the rotating force must be controlled. Controlling the rotating force eliminates the possibility of applying unforeseen twisting forces to the rigging (chokers, slings, etc.). Controlling the rotating force also reduces the amount of damage or harm produced should the rotating load which is being lifted come in contact with a fixed object or structure.

In the past, to rotate a suspended load such as during steel erection, a tag line and tag line person were used. This process involved controlling a suspended load by tying a rope to one (1) end of the load being lifted. However, attempting to control a suspended load from the ground can have numerous safety hazards. In addition, in some cases where the load is lifted high, obstructions to the tag line or the tag line person make the use of a tag line impossible. In this case, the operator must bump the load against some existing structure or object to try to get the load correctly positioned once the load is hoisted.

The related art has shown various types of load rotating devices which allow for slippage should the load encounter an obstacle. Illustrative are U.S. Pat. No. 2,823,944 to Anderson et al; U.S. Pat. No. 3,037,804 to Kraeling et al; U.S. Pat. No. 3,046,046 to Gris; U.S. Pat. No. 3,210,115 to Graham et al and U.S. Pat. No. 3,633,961 to Speransky.

Anderson et al describes a motorized swivel hook device. The swivel hook of the device has a vertical shank which is connected to a thrust collar extending between a flange at the bottom of the shank and the underside of a roller bearing. An annular flange of the thrust collar overlies the hub of a driven gear. The driven gear connects with a drive gear positioned on an output shaft of a speed reducer. The upper and lower faces of the flange of the collar are sandwiched between the driven gear and a plate. Friction material is interposed between the flange and the driven gear and the flange and the plate. By tightening nuts on bolts extending through the driven gear, flange and plate, a predetermined amount of frictional force is provided between the driven gear and plate on one hand and the thrust collar on the other hand. Thus, when the rotating hook encounters a resisting force exceeding the frictional force exerted on the flange, the gears will be able to rotate, with the driven gear and the plate frictionally slipping relative to the flange.

Kraeling et al describes a rotary hook for a traveling block for cranes. The crane hook block is comprised of the sheaves and the hook swivel which are secured to each other by means of parallel links. The rotary drive for rotating the hook relative to the block is provided with a friction clutch to prevent destruction of the gear drive if the hook is accidentally struck against an object and caused to twist which will cause the clutch to slip rather than destroy the apparatus. Thus slippages occur between the hook nut which is connected to the spindle of the hook clevis and the ring gear which is rotated by the pinion on the end of the output shaft of the gear reducer. Springs are used to provide sufficient compression to provide a friction drive between the upper and lower faces of the ring gear and the friction clutch linings. One (1) friction clutch lining is located between the lower face of the ring gear and the shoulder of the hook nut. The other friction clutch lining is located between the upper face of the ring gear and the pressure rings which hold the springs.

Gris describes a motor activated rotary crane hook. In each embodiment the hook is connected to the upper member by a swivel connection which allows for manual rotation of the load when necessary. The object of this invention is to provide a power means for rotating the hook in relation to its upper member. In each embodiment, the motor acts to rotate the hook directly. The hook does not rotate with the shaft.

Graham et al describes a power rotatable hook device which includes a torque limiting means such that if the load meets an obstruction, the torque limiting device would slip which would enable the motor to continue running. When the obstruction is removed, the load resumes rotation. The torque limiting means is of the slip type and can be of the eddy current type. The torque limiting device is selected so that it will slip at a torque value less than that which the speed reducer can safely handle.

Speransky describes a crane hook rotated by power for proper load orientation. The invention includes a hollow shaft which is connected to a shank extension of the shank of the hook. An electric motor rotates the hollow shaft and the hook. A plunger is slidably mounted in the shaft and an insert is disposed between the upper end of the shank extension and the lower end of the plunger. The upper end of the insert has a keyway within which is disposed a radial key carried by the lower end of the plunger. This key has tapered sidewalls so that the key will ride out of the keyway should the hook encounter turning resistance.

Also of interest are U.S. Pat. No. 3,009,728 to Breslav and U.S. Pat. No. 5,125,707 to Chaen et al.

Breslav describes a rotatable load supporting or lifting device. The speed reduction device used in rotating the hook includes a worm gear and worm shaft. A friction clutch is located on the worm shaft to drive the worm under ordinary conditions. The clutch allows slippage between the motor and the worm when the worm meets an obstruction.

Chaen et al describes a rotary load lifting device which allows for remotely operating the driving device provided on a hook block which is connected to a load lifting hook. The driving device and hook block each have chain wheels which are connected together by a chain.

There remains the need for a rotary device which includes a telescoping boom for mounting on a material handler vehicle and which uses the weight of the load to produce friction between the driven shaft and the load to rotate the load while controlling the amount of friction so that if the load should encounter an obstacle during rotation, the frictional force will be overcome and the load will stop rotating.

SUMMARY OF THE INVENTION

The present invention relates to a unit having a boom and a load rotary device which is used to rotate a suspended load in a controlled manner. In one (1) embodiment, the unit includes a boom with a hydraulically powered, suspended load rotary device. The rotary device includes a first bracket fixably mounted to the boom. A second bracket is movably mounted to the first bracket. The first and second brackets each have V-shaped or triangular shaped openings. The brackets are connected together by a U-shaped, cylindrical connector which extends through each of the openings. The shape of the openings and the shape of the connector allows the second bracket to swing freely with respect to the first bracket. A motor bracket is mounted to the second bracket by a spacer. The spacer and motor bracket are mounted on a side opposite of the first bracket. The motor is mounted on the motor bracket such that the motor shaft extends downward through the motor bracket. The drive gear is mounted on the end of the motor shaft. A driven shaft extends from the second bracket through the spacer and motor bracket and through a third bracket rotatably mounted on the second end of the driven shaft. A driven gear is fixably mounted on the driven shaft between the motor bracket and the third bracket. The motor is positioned such that the teeth of the drive gear engage the teeth of the driven gear. The driven shaft extends through a hole in the third bracket. The third bracket is secured to the drive shaft by a nut. A friction plate is spaced between the third bracket and the nut. When a load is connected to the third bracket and the load is lifted, the weight of the load pulls the third bracket downward into frictional contact with the friction plate. To rotate the load, the motor is activated which rotates the drive gear which rotates the driven gear and drive shaft. The frictional contact between the third bracket and the friction plate causes the rotating drive shaft to rotate the third bracket and the load. The unit is used to provide a "safe and efficient" means to unload and erect steel structural framing members (columns, beams, trusses, etc.). The unit of the present invention will allow the operator of the material handler vehicle to lift and rotate a load of any size or weight by simply operating a hydraulic control lever.

In the present invention, the weight of the load itself produces the friction that controls the force to rotate the load. Regardless of the size or weight of the load, only a minimal force, sufficient to rotate the load, is needed to be applied to rotate the load. In addition, if the rotating load comes in contact with an obstacle, or if a person holds onto the load while the load is rotating, the operator loses his ability to rotate the load and the load stops rotating and the rotary device simply slips. Once the load is clear of the obstacle or the person releases the load, the operator regains control of the rotation of the load and only the minimal force is required to rotate the load.

One (1) feature of the present invention is the ability to rotate any suspended load, regardless of the weight of the load, with only minimal force. The weight of the load on the driven shaft on the top side of the friction plate and the bottom side of the first portion of the third bracket, provides the friction between the surfaces required to allow only minimal force to rotate the load. The friction caused between the friction plate and the first portion of the third bracket, allows the operator to rotate the load with minimal rotational force. The amount of steel-to-steel friction or frictional resistance (force) between the friction plate and the first portion of the third bracket is controlled by the weight of the load. The operator has unrestricted, precise control of the rotation of the driven shaft and of the friction plate while having only the weight controlled frictional force to rotate the third bracket and the load. Due to the frictional forces between the friction plate and the third bracket, the operator has precise control over the rotation of an unobstructed load by rotating the driven shaft. However, when the load comes in contact with an obstacle, the operator's control over rotation of the load becomes restricted. The use of a weight controlled frictional surface to rotate the load allows a person to hold or rotate the load in one (1) direction, while the operator is applying a force to rotate the load in the opposite direction.

The structural design of the boom and rotary unit make this unit extremely rugged and maintenance free. The simple construction of the unit makes it convenient and efficient and practical to use.

The present invention relates to a rotating device for rotating a load, which comprises: a first bracket having an opening; a second bracket having a first opening and a second opening; a first connector connected between the opening in the first bracket and the first opening in the second bracket to connect the first bracket to the second bracket; a driven shaft having a first end and a second end with the first end rotatably extending through the second opening in the second bracket; a driven gear fixably mounted on the driven shaft; a motor mounted on the second bracket; a motor shaft having opposed first and second ends and connected at the first end to the motor; a drive gear mounted at the second end of the motor shaft and positioned such that the drive gear engages the driven gear; a third bracket having an opening wherein the second end of the driven shaft rotatably extends through the opening to rotatably mount the third bracket to the driven shaft; and a second connector mounted on the third bracket configured to connect the load to the third bracket wherein, in use, with the load connected to the third bracket, the motor is activated to rotate the drive gear which rotates the driven gear and the driven shaft, as the driven shaft rotates, a weight of the load on the third bracket causes friction between the second end of the driven shaft and the third bracket which causes the driven shaft to rotate the third bracket and the load.

Further, the present invention relates to a rotating device for rotating a load, which comprises: a first bracket having an opening; a second bracket having a first portion perpendicular to a second portion with an opening in the first portion spaced apart from the second portion and a notch in the first portion adjacent an opening in the second portion; a first connector extending between and connected to the opening in the first bracket and the opening in the first portion of the second bracket to connect the first bracket to the second bracket; a driven shaft having a first end and a second end with the first end rotatably extending through the opening in the second portion of the second bracket and into the notch in the first portion of the second bracket; a driven gear fixably mounted on the driven shaft; a motor mounted on the second bracket; a motor shaft having opposed first and second ends and mounted at the first end to the motor; a drive gear mounted on the second end of the motor shaft and positioned such that the drive gear engages the driven gear; a third bracket having an opening wherein the second end of the driven shaft rotatably extends through the opening; and a second connector mounted on the third bracket configured to connect the load to the third bracket wherein, in use, with the load connected to the third bracket, when the motor is activated, the drive gear rotates the driven gear and the driven shaft, as the driven shaft rotates, a weight of the load on the third bracket causes friction between the second end of the driven shaft and the third bracket which causes the driven shaft to rotate the third bracket and the load.

Still further, the present invention relates to a load rotating device for use with a material handler vehicle having a boom to rotate a load, which comprises: a first bracket configured to be mounted on the boom of the material handler vehicle and having a triangular shaped opening; a second bracket having a first plate with a triangular shaped opening and a second plate mounted perpendicular to the first plate with a hole along a longitudinal axis of the device; a first connector extending between the triangular shaped openings of the first and second brackets to connect the first and second brackets; a motor bracket mounted to the second plate of the second bracket on a side opposite the first plate and having a hole aligned with the hole in the second plate of the second bracket, the motor bracket having a pair of opposed arms which extend outward perpendicular to the longitudinal axis of the device; a motor mounted on one of the arms of the motor bracket; a motor shaft having opposed first and second ends and connected at the first end to the motor and extending toward the second end parallel to the longitudinal axis of the device in a direction away from the first bracket; a drive gear mounted at the second end of the motor shaft opposite the motor; a driven shaft having opposed first and second ends with the first end positioned through the hole in the second plate of the second bracket and the hole in the motor bracket such as to extend along the longitudinal axis of the device; a driven gear fixably mounted on the driven shaft adjacent the drive gear such that the drive gear mounted on the motor shaft of the motor engages the driven gear to rotate the driven gear and driven shaft; a third bracket having a hole with the second end of the driven shaft rotatably mounted through the hole; a second connector mounted on the third bracket configured to connect the load to the third bracket; and a friction plate mounted on the second end of the driven shaft adjacent a side of the third bracket opposite the second bracket wherein, in use, when the load is secured to the third bracket and the motor is activated to rotate the driven shaft, a weight of the load on the third bracket causes friction between the third bracket and the friction plate which causes the driven shaft to rotate the third bracket and the load and wherein a force of friction between the third bracket and the friction plate is such that application of a force in a direction opposite to a direction of rotation of the driven shaft overcomes the force of friction between the third bracket and the friction plate such as to stop rotation of the load.

Further still, the present invention relates to a rotating unit for use with a lift vehicle for rotating a load, which comprises: a boom having a first end and a second end; a mounting bracket mounted on the first end of the boom configured to removably attach the rotating unit to the lift vehicle; a first bracket having an opening and mounted on the second end of the boom; a second bracket having a first portion perpendicular to a second portion with an opening in the first portion spaced apart from the second portion and a notch in the first portion adjacent an opening in the second portion; a first connector extending between and connected to the opening in the first bracket and the opening in the first portion of the second bracket to connect the first bracket and the second bracket together; a driven shaft having a first end and a second end with the first end rotatably extending through the opening in the second portion of the second bracket and into the notch in the first portion of the second bracket; a driven gear fixably mounted on the driven shaft; a motor connected to the second bracket; a motor shaft having opposed first and second ends and connect at the first end to the motor; a drive gear mounted on the second end of the motor shaft and positioned such that the drive gear engages the driven gear; a third bracket having an opening wherein the second end of the driven shaft rotatably extends through the opening; and a second connector mounted on the third bracket configured to connect the load to the third bracket wherein, in use, with the load connected to the third bracket and the motor activated, the motor rotates the motor shaft and drive gear which rotates the driven gear and the driven shaft, as the driven shaft rotates, a weight of the load on the third bracket causes friction between the second end of the driven shaft and the third bracket which causes the driven shaft to rotate the third bracket and the load.

Further, the present invention relates to a rotating unit for use with a lift vehicle for rotating a load, which comprises: a boom having a first end and a second end; a mounting bracket mounted on the first end of the boom and configured to removably attach the rotating unit to the lift vehicle; a first bracket mounted on the second end of the boom and having a triangular shaped opening; a second bracket having a first portion perpendicular to a second portion with an opening in the first portion spaced apart from the second portion, the opening having a triangular shape and a notch in the first portion adjacent an opening in the second portion; a first connector extending between and connected to the opening in the first bracket and the opening in the first portion of the second bracket; a driven shaft having a first end and a second end with the first end rotatably extending through the opening in the second portion of the second bracket and into the notch in the first portion of the second bracket; a driven gear fixably mounted on the driven shaft; a motor connected to the second bracket; a motor shaft having a first and second end and mounted at the first end to the motor; a drive gear mounted on the second end of the motor shaft and positioned such that the drive gear engages the driven gear; a third bracket having an opening wherein the second end of the driven shaft rotatably extends through the opening; a friction plate mounted on the second end of the driven shaft adjacent a side of the third bracket opposite the second bracket; and a second connector mounted on the third bracket and configured to connect the load to the third bracket wherein, in use, with the load connected to the third bracket and the motor activated, the motor rotates the drive gear which rotates the drive gear and the driven shaft, as the driven shaft rotates, a weight of the load on the third bracket causes friction between the friction plate and the third bracket which causes the driven shaft to rotate the third bracket and the load.

Finally, the present invention relates to a method for rotating a load which has been lifted using a material handler vehicle, which comprises the steps of: providing a rotary device configured to be attached to the material handler vehicle and including a first bracket having an opening and configured to be mounted on the material handler vehicle; a second bracket having a first portion perpendicular to a second portion with an opening in the first portion spaced apart from the second portion and a notch in the first portion adjacent an opening in the second portion; a first connector extending between and connected to the opening in the first bracket and the opening in the first portion of the second bracket to connect the first and second bracket together; a driven shaft having a first end and a second end with the first end rotatably extending through the opening in the second portion of the second bracket and into the notch in the first portion of the second bracket; a driven gear fixably mounted on the driven shaft; a motor having a motor shaft and a drive gear and positioned such that the drive gear engages the driven gear; a third bracket having an opening wherein the second end of the driven shaft rotatably extends through the opening; and a second connector mounted on the third bracket and configured to connect the load to the third bracket; attaching the rotary device to the material handler vehicle; attaching the load to the third bracket of the rotary device using the second connector; and activating the motor which rotates the motor shaft, the drive gear, the driven gear and the driven shaft wherein a weight of the load on the third bracket causes friction between the second end of the driven shaft and the third bracket such that the third bracket with the load rotates with the driven shaft.

The substance and advantages of the present invention will become increasingly apparent by reference to the following drawings and the description.

DESCRIPTION OF THE PREFERRED EMBODIMENTS

Figure 1:
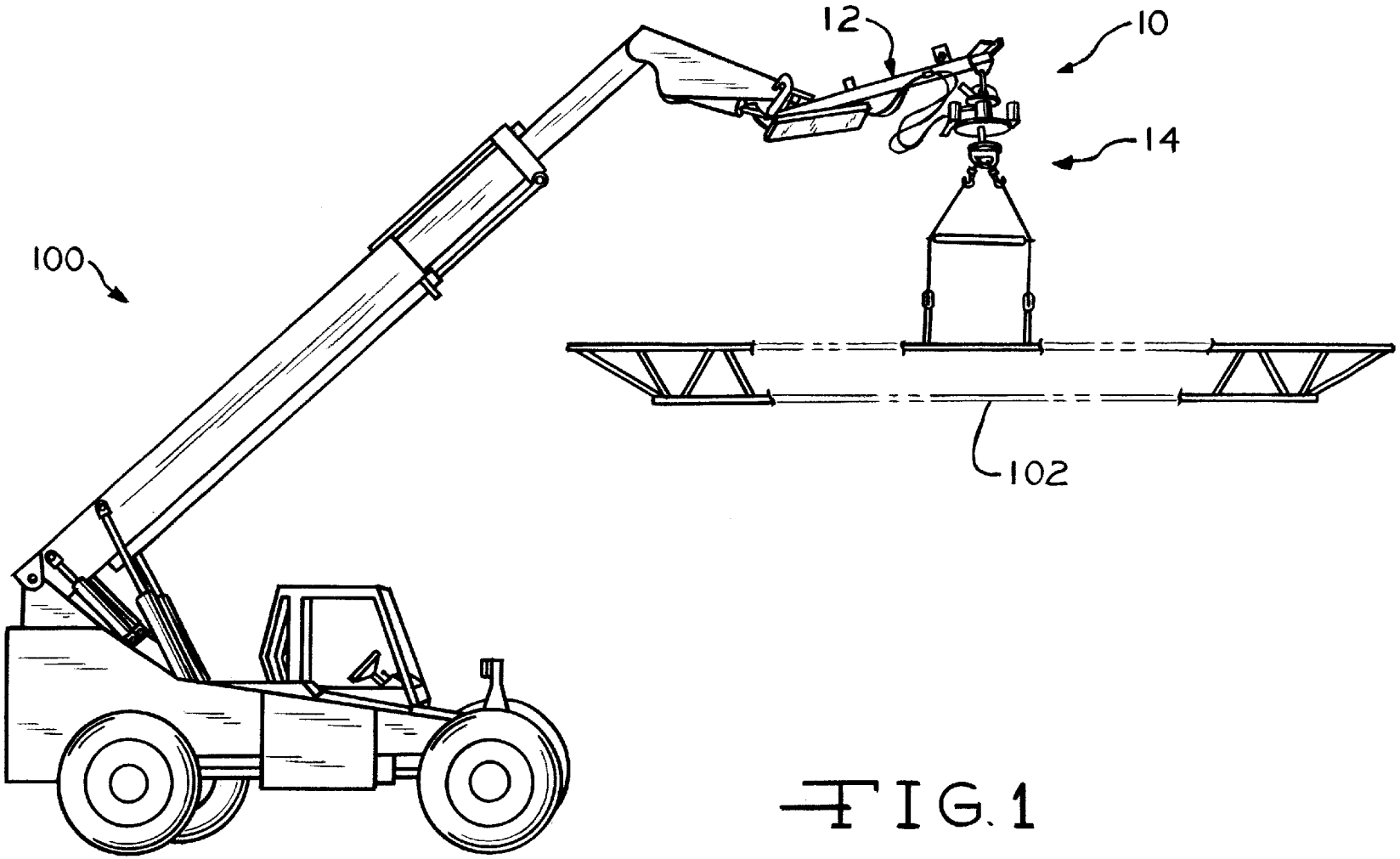
FIG. 1 is a side view showing the boom and rotary unit 10 attached to a material handler vehicle 100 and having a load 102 suspended from the rotary device 14.
Figure 2:
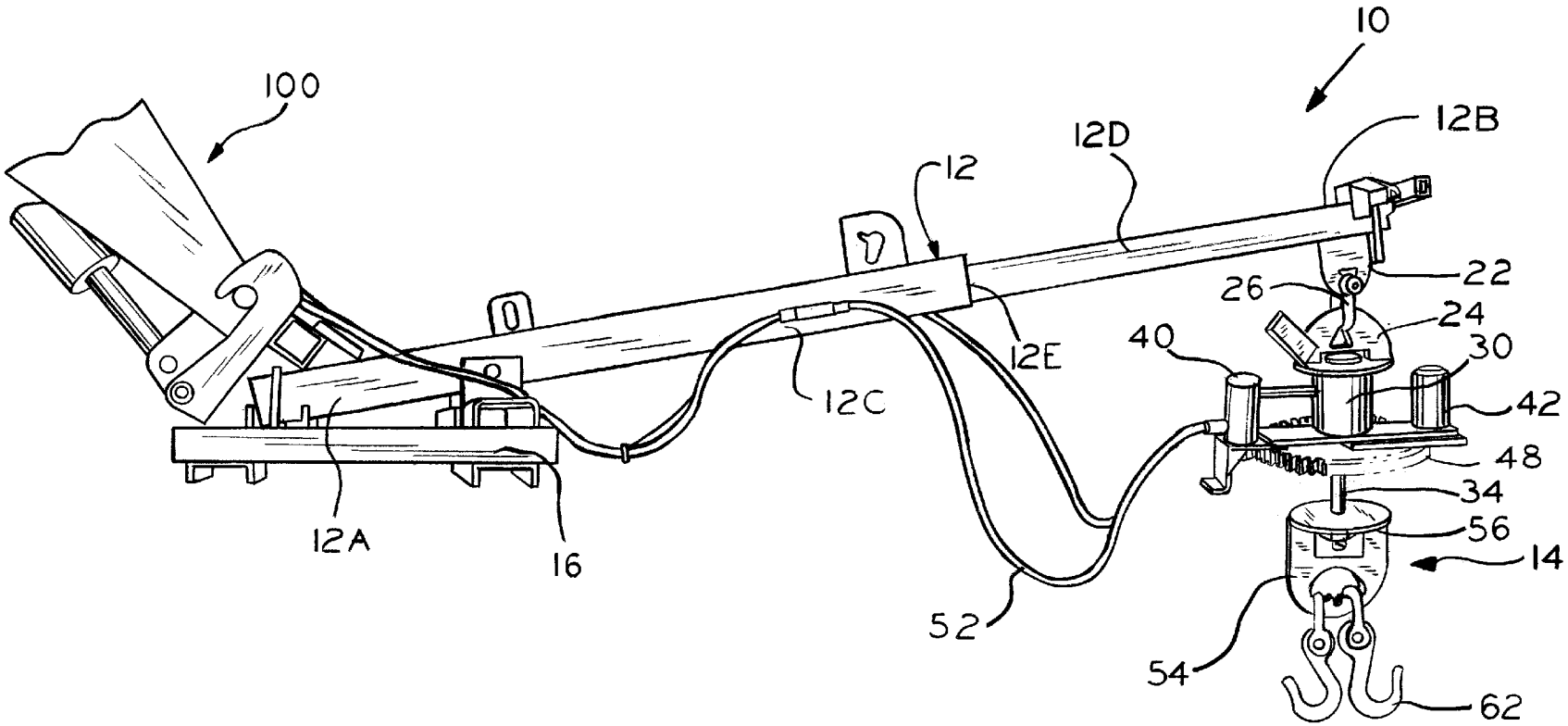
FIG. 2 is a perspective view of the boom and rotary unit 10 showing the connection of the boom 12 to the material handler vehicle 100.
Figure 3:
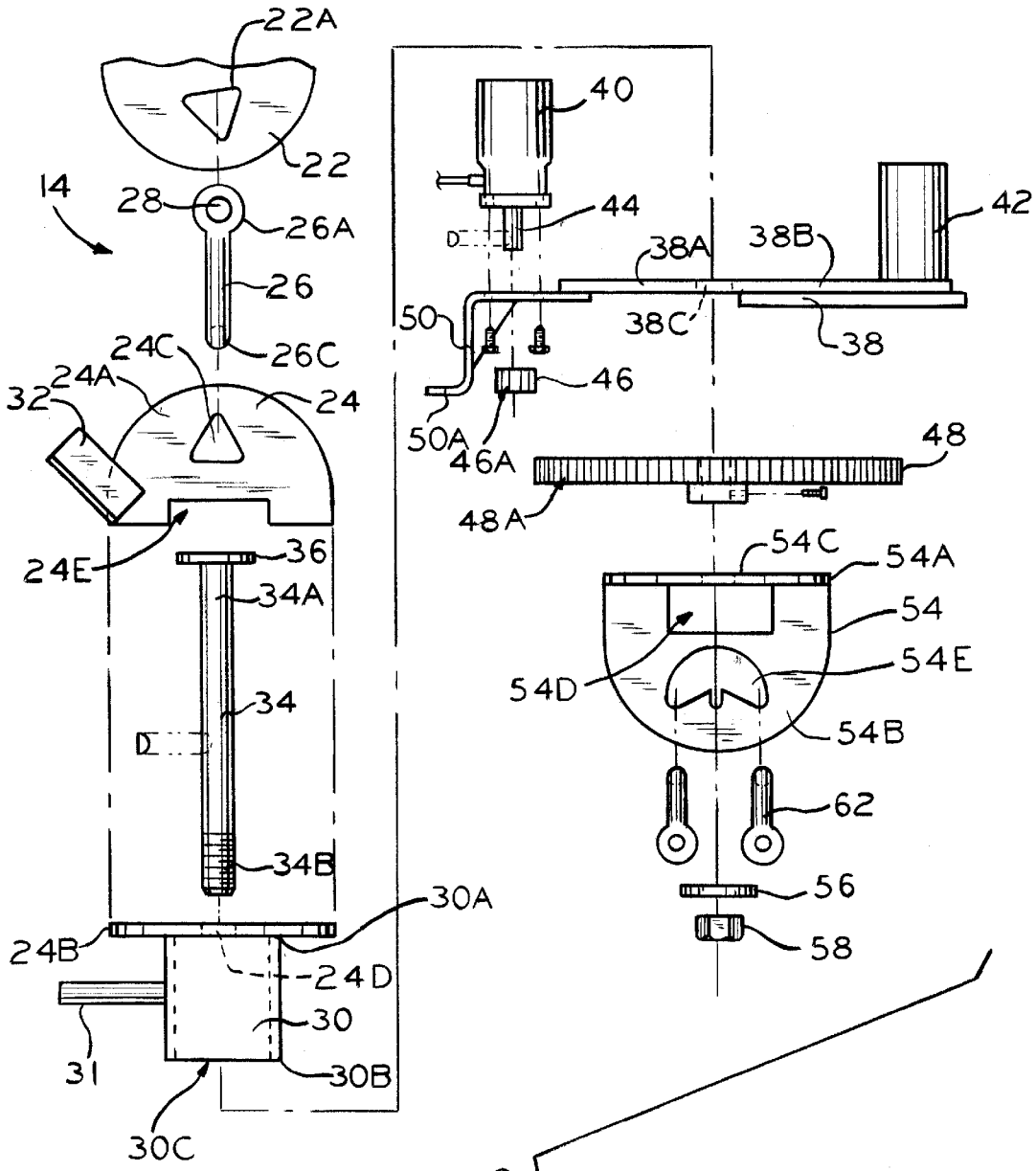
FIG. 3 is an exploded view of the rotary device 14.
Figure 4:
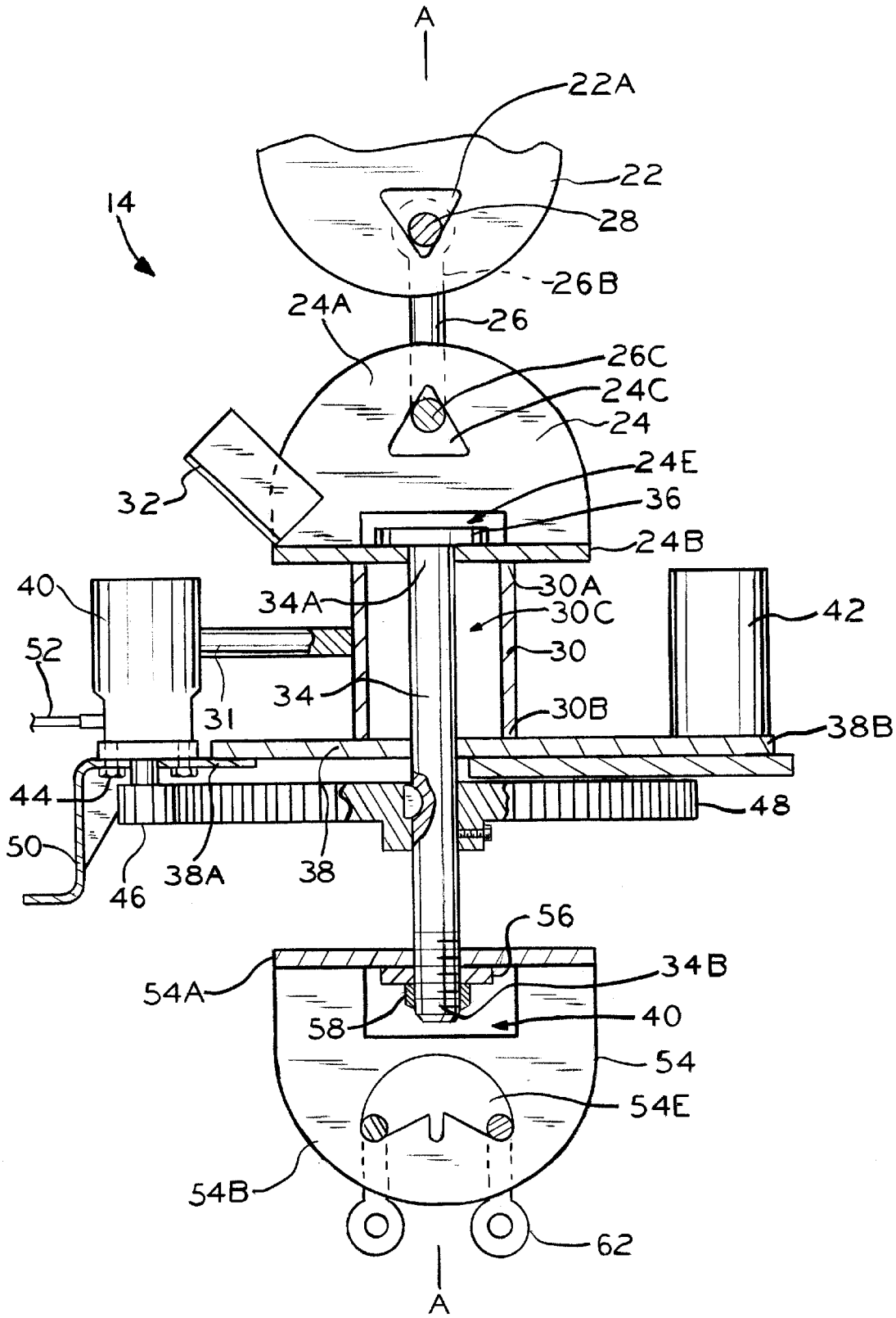
FIG. 4 is a cross-sectional view of the rotary device 14 with the boom 12 in the horizontal position and with the driven shaft 34 and driven gear 48 in elevation.

The boom and rotary unit 10 of the present invention includes a boom 12 and a rotary device 14. The boom 12 has opposed first and second ends 12A and 12B with a mounting bracket 16 at the first end 12A (FIG. 2). The mounting bracket 16 allows for attaching the unit 10 to a standard telescoping boom material handler vehicle 100 (FIG. 1). The mounting bracket 16 may have a variety of different shapes and sizes depending on the type and size of material handler vehicle 100 or other vehicle to which the unit 10 is to be attached. In one (1) embodiment, the unit 10 is attached to a 8042 manufactured by Skytrak located in Watertown, S.Dak. In one (1) embodiment, the boom 12 of the unit 10 is a telescoping boom 12 having a first portion 12C and a second portion 12D with the second portion 12D slidably mounted in an end 12E of the first portion 12C opposite the mounting bracket 16 so that the boom 12 is extendable. The first or upper bracket 22 is mounted on the second end 12B of the boom 12 and allows for connecting the rotary device 14 to the boom 12. In one (1) embodiment, the first bracket 22 has a D shape with the straight side mounted to an underside of the second end 12B of the boom 12. It is understood that the first bracket 22 could have a variety of different shapes. The first bracket 22 has an opening 22A for connecting the first bracket 22 to the second bracket 24. The opening 22A is preferably centrally positioned. In one (1) embodiment, the opening 22A in the first bracket 22 is V-shaped or has a triangular shape and is positioned such that the bottom of the V or one (1) apex of the triangle points downward toward the curved side of the first bracket 22 away from the boom 12. When the boom 12 is in the horizontal position parallel to a ground surface, the first bracket 22 is directly above the second bracket 24 and the V-shaped opening 22A of the first bracket 22 points toward the V-shaped opening 22A in the first portion 24A of the second bracket 24 (FIG. 4).

The second bracket 24 is connected by a first connector or shackle 26 to the first bracket 22. In one (1) embodiment, the second bracket 24 includes a first portion 24A and a second portion 24B. The first portion 24A can be of any shape. In one (1) embodiment, the first portion 24A has a D-shape with the second portion 24B mounted along the straight side of the D-shaped first portion 24A, perpendicular to the first portion 24A. The second portion 24B can be of any shape. In one (1) embodiment, the second portion 24B has a circular shape. The first portion 24A of the second bracket 24 has an opening 24C. In one (1) embodiment, the opening 24C in the first portion 24A of the second bracket 24 is V-shaped or has a triangular shape. The V or triangular shaped opening 24C in the second bracket 24 is positioned such that the bottom of the V or one (1) apex of the triangle points upwards toward the curved side of the second bracket 24 and toward the first bracket 22 (FIG. 4). The first connector or shackle 26 is rotatably mounted through the triangular shaped openings 22A and 24C in the first and second brackets 22 and 24. When the first and second brackets 22 and 24 are connected together by the first connector 26, the curved sides of the first and second brackets 22 and 24 are adjacent with one (1) of the apexes of each of the triangular shaped openings 22A and 24A pointing towards each other. The first connector 26 is preferably a cylindrical rod having a U-shape with a first and second end 26A and 26B with a center portion 26C spaced between the ends 26A and 26B. The ends 26A and 26B of the first connector 26 each have an opening through which a cylindrical pin 28 is positioned. In one (1) embodiment, the center portion 26C of the U-shaped first connector 26 is positioned in the apex of the opening 24A of the second bracket 24 and the pin 28 is located in the apex of the opening 22A of the first bracket 22 with the first and second ends 26A and 26B of the first connector 26 on either side of the first bracket 22. Spacers (not shown) can be provided between the first bracket 22 and the ends 26A and 26B of the first connector 26 to prevent extraneous side to side motion of the first connector 26 and to prevent free rotation of the second bracket 24. The second portion 24B of the second bracket 24 also has an opening 24D. The opening 24D is preferably in the center of the second portion 24B. The opening 24D of the second portion 24B is perpendicular to the opening 24C of the first portion 24A of the second bracket 24.

A spacer 30 having a first and second end 30A and 30B is mounted at the first end 30A on the second portion 24B of the second bracket 24 on a side opposite the first portion 24A of the second bracket 24. The spacer 30 is mounted perpendicular to the second portion 24B over the opening 24D in the second portion 24B. In one (1) embodiment, the spacer 30 is a hollow cylinder having a center bore 30C and is mounted such that the center bore 30C of the spacer 30 is co-axial with the opening 24D in the second portion 24B of the second bracket 24 and co-axial with the longitudinal axis A—A of the rotary device 14 (FIG. 4). In one (1) embodiment, a stabilizing rod 31 is mounted on the spacer 30 and extends between the spacer 30 and the motor 40. The stabilizing rod 31 assists in keeping the motor 40 and the drive gear 46 aligned with the driven gear 48. A stop 32 is mounted on the second bracket 24 on the side of the second bracket 24 closest to the boom 12. In one (1) embodiment, the stop 32 is mounted on the top side of the second portion 24B of the second bracket 24 on either side of the first portion 24A of the second bracket 24. The stop 32 is preferably mounted at an angle and extends outward beyond the second bracket 24 toward the boom 12.

A driven shaft 34 having a first and second end 34A and 34B extends downward through the opening 24D in the second portion 24B of the second bracket 24 and through the center bore 30C of the spacer 30. The driven shaft 34 is positioned co-axial with the longitudinal axis A—A of the rotary device 14 (FIG. 4). The first end 34A of the driven shaft 34 has a cap 36 which has a size or diameter greater than the size or diameter of the opening 24D in the second portion 24B of the second bracket 24. The cap 36 prevents the driven shaft 34 from falling through the opening 24D in the second bracket 24. A lubricant (not shown) or a grease fitting is preferably provided between the second portion 24B of the second bracket 24 and cap 36 to allow the driven shaft 34 to rotate freely in the second bracket 24. The lubricant also prevents wear between the second bracket 24 and the cap 36. The first portion 24A of the second bracket 24 has a notch 24E along one (1) edge adjacent the second portion 24B. The notch 24E is positioned adjacent and over the opening 24D in the second portion 24B of the second bracket 24. The notch 24E has a length greater than the width or diameter of the opening 24D in the second portion 24B of the second bracket 24. The notch 24E accommodates the cap 36 of the driven shaft 34 and allows for rotation of the driven shaft 34 in the second bracket 24.

A motor bracket 38 is mounted on the second end 30B of the spacer 30, perpendicular to the spacer 30. The motor bracket 38 has arms 38A and 38B which extend outward on either side of the spacer 30. The motor bracket 38 has a hole 38C which corresponds to the center bore 30C of the spacer 30 and allows the driven shaft 34 to extend through the motor bracket 38 and to rotate freely in the hole 38C in the motor bracket 38. The hole 38C is preferably in the center of the bracket 38 equally spaced between the ends of the arms 38A and 38B of the bracket 38. A motor 40 is mounted at the end of one (1) of the arms 38A of the motor bracket 38. A counterweight 42 is mounted at the end of the other arm 38B of the motor bracket 38 and acts to counterbalance the weight of the motor 40. In one (1) embodiment, the motor 40 is hydraulically powered. The hydraulics from the material handler vehicle 100 can be used to power the motor 40 (FIG. 2). The motor 40 is mounted such that the motor shaft 44 of the motor 40 extends downward parallel to the driven shaft 34 through a hole (not shown) in the motor bracket 38. A drive gear 46 is fixably mounted on the end of the motor shaft 44 opposite the motor 40. The drive gear 46 is spaced below the motor bracket 38. A driven gear 48 is fixably mounted to the driven shaft 34 below the motor bracket 38. The driven gear 48 can be mounted to the driven shaft 34 by any well known means. The driven shaft 34 extends through the center of the driven gear 48. The perimeter of the driven gear 48 has teeth 48A which engage the teeth 46A on the perimeter of the drive gear 46. In one (1) embodiment, a guard 50 is mounted on the motor bracket 38 adjacent the motor 40. The guard 50 extends downward adjacent the drive gear 46. The guard 50 preferably has an L-shape such that the bottom portion 50A of the guard 50 extends outward away from the drive gear 46. The guard 50 prevents damage to the drive gear 46 and driven gear 48. The guard 50 also prevents objects including the hydraulic lines 52 for the motor 40 from getting caught between the drive and driven gears 46 and 48.

A third or load holding bracket 54 is mounted on the second end 34B of the driven shaft 34 opposite the cap 36. In one (1) embodiment, the third bracket 54 is similar to the second bracket 24 and has a first portion 54A and a second portion 54B. The first portion 54A of the third bracket 54 is similar to the second portion 24B of the second bracket 24 and has a circular shape. The second portion 54B of the third bracket 54 has a D-shape similar to the shape of the first bracket 22. The second portion 54B of the third bracket 54 is mounted perpendicular to the first portion 54A of the third bracket 54 on a side opposite the second bracket 24. The first portion 54A of the third bracket 54 has a center opening or hole 54C through which the second end 34B of the driven shaft 34 extends. The hole 54C is of such a size as to allow the driven shaft 34 to freely rotate in the hole 54C. The second portion 54B of the third bracket 54 has a notch 54D along the straight side which extends along the opening in the first portion 54A of the third bracket 54. The notch 54D has a length at least equal to the width or diameter of the hole 54C in the first portion 54A of the third bracket 54. A friction plate 56 is mounted on the second end 34B of the driven shaft 34 below the third bracket 54 such that the first portion 54A of the third bracket 54 is in contact with the friction plate 56. In one (1) embodiment, the friction plate 56 is rotatably mounted on the second end 34B of the driven shaft 34. The notch 54D in the second portion 54B of the third bracket 54 accommodates the second end 34B of the driven shaft 34 and the friction plate 56. In one (1) embodiment, a nut 58 is threadably secured on the second end 34B of the driven shaft 34 and acts to hold the friction plate 56 on the driven shaft 34. This allows for easy replacement of the friction plate 56 in case of wear or damage to the friction plate 56. It also allows for easily changing the third bracket 54 should a different type of bracket be required. In another embodiment, the friction plate 56 is permanently mounted on the driven shaft 34 such as by welding.

In one (1) embodiment, the second portion 54B of the third bracket 54 also has openings 54E to allow for connecting a load 102. The openings 54E are preferably curved with low points at each side. A pair of hooks or connectors 62 are preferably Positioned in each of the low points of the openings 54E to allow for connection to a load 102. The load 102 is preferably connected to the unit 10 by steel cables. However, it is understood that any type of connector can be attached to the third bracket 54 to allow for connecting the load 102 to the rotary device 14 and unit 10.

The unit 10 is intended to be used to maneuver and rotate a suspended load 102. In one (1) embodiment, the boom and rotary unit 10 is configured as an attachment for a telescoping boom material handler 100. However, it is understood that the unit 10 will work equally well on any type of forklift equipped with auxiliary hydraulic power near the back of the forks. The mounting bracket 16 on the boom 12 can include quick connect hardware which matches the particular telescoping material handler vehicle 100 to allow the unit 10 to be used with a material handler vehicle 100 either with or without the mast and forks. Without the mast and forks, operator visibility is improved and lifting capacity increases equal to the weight of the mast and forks. It is also understood that the unit 10 or the rotary device 14 can be used with any type of material lifting device or vehicle. Although it is intended that the unit 10 be mounted on a material handler vehicle 100, the unit 10 could be mounted on any type of vehicle. Further, the unit 10 could be mounted on a fixed structure. In one (1) embodiment, with the unit 10 attached to a material handler vehicle 100, the unit 10 is attached to the material handler vehicle 100 by the mounting bracket 16 located at the first end 12A of the boom 12. In this embodiment, the material handler vehicle 100 has tangs or forks which extend into openings in the mounting bracket 16 to allow for quick and easy connecting and disconnecting of the material handler vehicle 100 and unit 10. In one (1) embodiment the motor 40 is hydraulically operated and during attachment of the unit 10 to the material handler vehicle 100, the hydraulic lines 52 for the motor 40 of the rotary device 14 are connected to the hydraulic system of the material handler vehicle 100 (FIG. 2). The hydraulic lines 52 are positioned such as to not interfere with the operation of the material handler vehicle 100 or the unit 10. Once the unit 10 is fully attached, the material handler vehicle 100 is moved such as to position the rotary device 14 over the load 102 to be lifted. The load 102 is then attached to the third bracket 54. The load 102 can be connected to the third bracket 54 by any well known means. In one (1) embodiment, the load 102 is a structural steel beam which is connected to chains or wires which are connected to hooks 62 which are mounted through openings 54E in the second portion 54B of the third bracket 54. Once the load 102 is connected to the unit 10, the material handler vehicle 100 and unit 10 can be adjusted to move and position the load 102. In one (1) embodiment, the load 102 is lifted or suspended for positioning the load 102. The load 102 is lifted by extending and/or lifting the arm of the material handler vehicle 100. The load 102 can be further lifted or positioned by extending the telescoping boom 12 of the unit 10. Once the load 102 is at the correct height, the load 102 is further positioned using the rotary device 14. The load 102 is positioned by controlled rotation of the load 102 using the rotary device 14.

For the most effective and efficient operation, the rotary device 14 below the first bracket 22 is preferably allowed to swing and oscillate freely from the boom 12. It is also important that the load 102 be able to swing freely. Being able to swing and oscillate freely greatly reduces the possibility of inducing a snapping motion in the load 102 while traveling over rough terrain. A snapping motion applies unsafe shock loads to the rigging. The rotary device 14 is able to swing and oscillate freely due to the first bracket 22 and second bracket 24 having V-shaped or triangular shaped openings 22A and 24C connected together by a first connector 26. This connection allows the rotary device 14 to swing and oscillate freely below the first bracket 22 while preventing free rotation of the second bracket 24. To be effective, the second bracket 24 can not rotate. The free swing of the rotary device 14 along with a slower travel speed on rough terrain by the material handler vehicle 100 having the unit 10 will eliminate any snapping motion. In addition, testing has shown minimal wear to the V or triangular shaped openings 22A and 22B in the first and second brackets 22 and 24. However, preferably this minimal wear enhances the ability of the load rotary device 14 to resist free rotation around the longitudinal axis A—A of the device 14. The free swing connection between the first bracket 22 and the second bracket 24 caused by the openings 22A and 22B and the first connector 26 allows the rotary device 14, except the first bracket 22, and the load 102 to pivot into an essentially vertical position with respect to the ground surface due to gravity. The stop 32 positioned adjacent the boom 12 on one (1) side of the second bracket 24 prevents the rotary device 14 from contacting the boom 12 during free swing. To rotate the load 102, the user activates the hydraulics and starts the motor 40. The motor 40 rotates the motor shaft 44 which rotates the drive gear 46. The teeth 46A of the drive gear 46 engage the teeth 48A of the driven gear 48 and the driven shaft 34. Rotation of the driven shaft 34 causes the load 102 to rotate due to the weight of the load 102 which causes friction between the first portion 54A of the third bracket 54 and the friction plate 56. The load 102 can be rotated in either direction for any number of full or partial rotations. However, if an obstacle, including a person, is in the path of the rotating load 102 or in some way tries to prevent rotation of the load 102, slippage occurs between the first portion 54A of the third bracket 54 and the friction plate 56 which prevents damage to the load 102, obstruction and unit 10. Only a minimal amount of force is needed to be applied to the load 102 in a direction opposite the direction of rotation to overcome the force of friction between the third bracket 54 and the friction plate 56 and to stop rotation. Once the obstacle or force is removed, the load 102 is again free to rotate. In steel erection, the steel to steel friction between the friction plate 56 and the third bracket 54 appears to be ideal for most framing members which are lifted. For other applications, modifications can be made to change the rotating force by simply adding additional friction plates between the friction plate 56 and the third bracket 54.

It is intended that the foregoing description be only illustrative of the present invention and that the present invention be limited only by the hereinafter appended claims.

I claim:

1. A rotating device for rotating a load, which comprises:

(a) a first bracket having an opening;

(b) a second bracket having a first opening and a second opening;

(c) a first connector connected between the opening in the first bracket and the first opening in the second bracket to connect the first bracket to the second bracket;

(d) a driven shaft having a first end and a second end with the first end rotatably extending through the second opening in the second bracket;

(e) a driven gear fixably mounted on the driven shaft;

(f) a motor mounted on the second bracket;

(g) a motor shaft having opposed first and second ends and connected at the first end to the motor;

(h) a drive gear mounted at the second end of the motor shaft and positioned such that the drive gear engages the driven gear;

(i) a third bracket having an opening wherein the second end of the driven shaft rotatably extends through the opening to rotatably mount the third bracket to the driven shaft; and (j) a second connector mounted on the third bracket configured to connect the load to the third bracket wherein, in use, with the load connected to the third bracket, the motor is activated to rotate the drive gear which rotates the driven gear and the driven shaft, as the driven shaft rotates, a weight of the load on the third bracket causes friction between the second end of the driven shaft and the third bracket which causes the driven shaft to rotate the third bracket and the load.

2. The device of claim 1 wherein the opening in the first bracket has a triangular shape and is oriented such that one apex of the triangle points in a direction essentially toward the second bracket.

3. The device of claim 1 wherein the first opening of the second bracket has a triangular shape and is oriented such that one apex of the triangle points in a direction essentially toward the first bracket.

4. The device of claim 1 wherein a motor bracket is fixably mounted on the second bracket and wherein the motor is mounted on the motor bracket.

5. The device of claim 4 wherein a spacer having a first end and a second end is mounted at the first end on the second bracket and wherein the motor bracket is mounted on the second end of the spacer such that the motor bracket is spaced apart from the second bracket.

6. The device of claim 1 wherein the second bracket has a first portion and a second portion and wherein the second portion is mounted perpendicular to the first portion wherein the first opening is in the first portion and the second opening is in the second portion and wherein the second opening is perpendicular to the first opening.

7. The device of claim 1 wherein a friction plate is fixably mounted on the second end of the driven shaft adjacent a side of the third bracket opposite the second bracket.

8. A rotating device for rotating a load, which comprises:

(a) a first bracket having an opening;

(b) a second bracket having a first portion perpendicular to a second portion with an opening in the first portion spaced apart from the second portion and a notch in the first portion adjacent an opening in the second portion;

(c) a first connector extending between and connected to the opening in the first bracket and the opening in the first portion of the second bracket to connect the first bracket to the second bracket;

(d) a driven shaft having a first end and a second end with the first end rotatably extending through the opening in the second portion of the second bracket and into the notch in the first portion of the second bracket;

(e) a driven gear fixably mounted on the driven shaft;

(f) a motor mounted on the second bracket;

(g) a motor shaft having opposed first and second ends and mounted at the first end to the motor;

(h) a drive gear mounted on the second end of the motor shaft and positioned such that the drive gear engages the driven gear;

(i) a third bracket having an opening wherein the second end of the driven shaft rotatably extends through the opening; and (j) a second connector mounted on the third bracket configured to connect the load to the third bracket wherein, in use, with the load connected to the third bracket, when the motor is activated, the drive gear rotates the driven gear and the driven shaft, as the driven shaft rotates, a weight of the load on the third bracket causes friction between the second end of the driven shaft and the third bracket which causes the driven shaft to rotate the third bracket and the load.

9. The device of claim 8 wherein the opening in the first bracket has a triangular shape and is oriented such that one apex of the triangle is adjacent the second bracket.

10. The device of claim 8 wherein the first opening in the first portion of the second bracket has a triangular shape and is oriented such that one apex of the triangle is adjacent the first bracket.

11. The device of claim 8 wherein a motor bracket is fixably mounted on the second bracket and wherein the motor is mounted on the motor bracket.

12. The device of claim 11 wherein the motor bracket has a first end and a second end, wherein the motor is mounted adjacent the first end of the motor bracket and wherein a counterbalance weight is mounted adjacent the second end of the motor bracket to counterbalance a weight of the motor.

13. The device of claim 11 wherein a spacer having a first end and a second end is mounted at the first end on the second portion of the second bracket and wherein the motor bracket is mounted on the second end of the spacer such that the motor bracket is spaced apart from the second bracket.

14. The device of claim 8 wherein the first portion of the second bracket has a D-shape with the second portion mounted along a straight edge of the first portion and wherein the opening in the first portion is perpendicular to the opening in the second portion.

15. The device of claim 8 wherein a friction plate is fixably mounted on the second end of the driven shaft adjacent a side of the third bracket opposite the second bracket.

16. The device of claim 8 wherein the first connector includes a cylindrical rod having a U-shape with first and second ends and first and second openings at the first and second ends respectfully, and a cylindrical pin, wherein the first connector is positioned such that a center portion of the cylindrical rod opposite the ends extends through and is adjacent the opening in the first portion of the second bracket and the ends of the cylindrical rod are adjacent the opening in the first bracket such that the pin extends through the first opening in the first end and through the opening in the first bracket and through the second opening in the second end.

17. A load rotating device for use with a material handler vehicle having a boom to rotate a load, which comprises:

(a) a first bracket configured to be mounted on the boom of the material handler vehicle and having a triangular shaped opening;

(b) a second bracket having a first plate with a triangular shaped opening and a second plate mounted perpendicular to the first plate with a hole along a longitudinal axis of the device;

(c) a first connector extending between the triangular shaped openings of the first and second brackets to connect the first and second brackets;

(d) a motor bracket mounted to the second plate of the second bracket on a side opposite the first plate and having a hole aligned with the hole in the second plate of the second bracket, the motor bracket having a pair of opposed arms which extend outward perpendicular to the longitudinal axis of the device;

(e) a motor mounted on one of the arms of the motor bracket;

(f) a motor shaft having opposed first and second ends and connected at the first end to the motor and extending toward the second end parallel to the longitudinal axis of the device in a direction away from the first bracket;

(g) a drive gear mounted at the second end of the motor shaft opposite the motor;

(h) a driven shaft having opposed first and second ends with the first end positioned through the hole in the second plate of the second bracket and the hole in the motor bracket such as to extend along the longitudinal axis of the device;

(i) a driven gear fixably mounted on the driven shaft adjacent the drive gear such that the drive gear mounted on the motor shaft of the motor engages the driven gear to rotate the driven gear and driven shaft;

(j) a third bracket having a hole with the second end of the driven shaft rotatably mounted through the hole;

(k) a second connector mounted on the third bracket configured to connect the load to the third bracket; and (l) a friction plate mounted on the second end of the driven shaft adjacent a side of the third bracket opposite the second bracket wherein, in use, when the load is secured to the third bracket and the motor is activated to rotate the driven shaft, a weight of the load on the third bracket causes friction between the third bracket and the friction plate which causes the driven shaft to rotate the third bracket and the load and wherein a force of friction between the third bracket and the friction plate is such that application of a force in a direction opposite to a direction of rotation of the driven shaft overcomes the force of friction between the third bracket and the friction plate such as to stop rotation of the load.

18. A rotating unit for use with a lift vehicle for rotating a load, which comprises:

(a) a boom having a first end and a second end;

(b) a mounting bracket mounted on the first end of the boom configured to removably attach the rotating unit to the lift vehicle;

(c) a first bracket having an opening and mounted on the second end of the boom;

(d) a second bracket having a first portion perpendicular to a second portion with an opening in the first portion spaced apart from the second portion and a notch in the first portion adjacent an opening in the second portion;

(e) a first connector extending between and connected to the opening in the first bracket and the opening in the first portion of the second bracket to connect the first bracket and the second bracket together;

(f) a driven shaft having a first end and a second end with the first end rotatably extending through the opening in the second portion of the second bracket and into the notch in the first portion of the second bracket;

(g) a driven gear fixably mounted on the driven shaft;

(h) a motor connected to the second bracket;

(i) a motor shaft having opposed first and second ends and connect at the first end to the motor;

(j) a drive gear mounted on the second end of the motor shaft and positioned such that the drive gear engages the driven gear;

(k) a third bracket having an opening wherein the second end of the driven shaft rotatably extends through the opening; and (l) a second connector mounted on the third bracket configured to connect the load to the third bracket wherein, in use, with the load connected to the third bracket and the motor activated, the motor rotates the motor shaft and drive gear which rotates the driven gear and the driven shaft, as the driven shaft rotates, a weight of the load on the third bracket causes friction between the second end of the driven shaft and the third bracket which causes the driven shaft to rotate the third bracket and the load.

19. The rotating unit of claim 18 wherein the opening in the first bracket has a triangular shape and is oriented such that one apex of the triangle is adjacent the second bracket.

20. The rotating unit of claim 18 wherein the first opening in the first portion of the second bracket has a triangular shape and is oriented such that one apex of the triangle is adjacent the first bracket.

21. The rotating unit of claim 18 wherein a motor bracket is fixably mounted on the second portion of the second bracket and wherein the motor is mounted on the motor bracket.

22. The rotating unit of claim 21 wherein the motor bracket has a first end and a second end and wherein the motor is mounted on the first end of the motor bracket and wherein a counterbalance weight is mounted on the second end of the motor bracket to counterbalance a weight of the motor.

23. The rotating unit of claim 21 wherein a spacer having a first end and a second end is mounted at the first end on the second portion of the second bracket and wherein the motor bracket is mounted on the second end of the spacer such that the motor bracket is spaced apart from the second bracket.

24. The device of claim 18 wherein the first portion of the second bracket has a D-shape with the second portion mounted along a straight edge of the first portion and wherein the opening in the first portion is perpendicular to the opening in the second portion.

25. The rotating unit of claim 18 wherein a friction plate is fixably mounted on the second end of the driven shaft adjacent a side of the third bracket opposite the second bracket.

26. The rotating unit of claim 18 wherein the first connector includes a cylindrical rod having a U-shape with first and second ends and first and second openings at the first and second ends respectively, and a cylindrical pin wherein the first connector is positioned such that a center portion of the cylindrical rod spaced between the ends extends through and is adjacent the first opening in the first portion of the second bracket and the ends of the cylindrical rod are adjacent the opening in the first bracket such that the pin extends through the first opening in the first leg and through the opening in the first bracket and through the second opening in the second leg.

27. The rotating unit of claim 18 wherein the boom has a first portion and a second portion with the second portion slidably and telescopingly mounted in an end of the first portion opposite the mounting bracket such that the boom is extendable.

28. The rotating unit of claim 18 wherein the vehicle is a material handler vehicle and wherein the mounting bracket has holes configured to accommodate tangs of the material handler vehicle to attach the unit to the material handler vehicle.

29. A rotating unit for use with a lift vehicle for rotating a load, which comprises:

(a) a boom having a first end and a second end;

(b) a mounting bracket mounted on the first end of the boom and configured to removably attach the rotating unit to the lift vehicle;

(c) a first bracket mounted on the second end of the boom and having a triangular shaped opening;

(d) a second bracket having a first portion perpendicular to a second portion with an opening in the first portion spaced apart from the second portion, the opening having a triangular shape and a notch in the first portion adjacent an opening in the second portion;

(e) a first connector extending between and connected to the opening in the first bracket and the opening in the first portion of the second bracket;

(f) a driven shaft having a first end and a second end with the first end rotatably extending through the opening in the second portion of the second bracket and into the notch in the first portion of the second bracket;

(g) a driven gear fixably mounted on the driven shaft;

(h) a motor connected to the second bracket;

(i) a motor shaft having a first and second end and mounted at the first end to the motor;

(j) a drive gear mounted on the second end of the motor shaft and positioned such that the drive gear engages the driven gear;

(k) a third bracket having an opening wherein the second end of the driven shaft rotatably extends through the opening;

(l) a friction plate mounted on the second end of the driven shaft adjacent a side of the third bracket opposite the second bracket; and (m) a second connector mounted on the third bracket and configured to connect the load to the third bracket wherein, in use, with the load connected to the third bracket and the motor activated, the motor rotates the drive gear which rotates the drive gear and the driven shaft, as the driven shaft rotates, a weight of the load on the third bracket causes friction between the friction plate and the third bracket which causes the driven shaft to rotate the third bracket and the load.

30. A method for rotating a load which has been lifted using a material handler vehicle, which comprises the steps of:

(a) providing a rotary device configured to be attached to the material handler vehicle and including a first bracket having an opening and configured to be mounted on the material handler vehicle; a second bracket having a first portion perpendicular to a second portion with an opening in the first portion spaced apart from the second portion and a notch in the first portion adjacent an opening in the second portion; a first connector extending between and connected to the opening in the first bracket and the opening in the first portion of the second bracket to connect the first and second bracket together; a driven shaft having a first end and a second end with the first end rotatably extending through the opening in the second portion of the second bracket and into the notch in the first portion of the second bracket; a driven gear fixably mounted on the driven shaft; a motor having a motor shaft and a drive gear and positioned such that the drive gear engages the driven gear; a third bracket having an opening wherein the second end of the driven shaft rotatably extends through the opening; and a second connector mounted on the third bracket and configured to connect the load to the third bracket;

(b) attaching the rotary device to the material handler vehicle;

(c) attaching the load to the third bracket of the rotary device using the second connector; and (d) activating the motor which rotates the motor shaft, the drive gear, the driven gear and the driven shaft wherein a weight of the load on the third bracket causes friction between the second end of the driven shaft and the third bracket such that the third bracket with the load rotates with the driven shaft.

31. The method of claim 30 wherein a friction plate is mounted on the second end of the driven shaft adjacent a side of the third bracket opposite the second bracket wherein a size and shape of the friction plate and a size and shape of the third bracket are chosen such that in step (d), the weight of the load connected to the third bracket causes friction between the friction plate and the third bracket and wherein when the load encounters an obstacle which tends to prevent rotation of the load, a force exerted by the obstacle on the load counteracts the friction between the friction plate and the third bracket such that the load does not rotate.

32. The method of claim 30 wherein the motor is hydraulically operated and the material handler vehicle is provided with a hydraulics system and wherein in step (b), the motor is connected to the hydraulic system of the material handler vehicle.

* * * * *